US008113677B2

(12) United States Patent
Carpenter

(10) Patent No.: US 8,113,677 B2
(45) Date of Patent: Feb. 14, 2012

(54) HEADLYTE SAFETY DEVICE

(76) Inventor: Alan Ewald Carpenter, Windham, NH (US)

( * ) Notice: Subject to any disclaimer, the term of this patent is extended or adjusted under 35 U.S.C. 154(b) by 389 days.

(21) Appl. No.: 12/408,706

(22) Filed: Mar. 22, 2009

(65) Prior Publication Data

US 2010/0238682 A1 Sep. 23, 2010

(51) Int. Cl.
*F21V 21/084* (2006.01)

(52) U.S. Cl. ..... 362/105; 362/473; 362/486

(58) Field of Classification Search ..... 362/103, 362/106, 108, 234, 249.02, 249.06, 551, 362/554, 555, 570, 190, 191, 276, 105, 184; 340/425.5, 432, 468, 470, 475, 478, 479
See application file for complete search history.

(56) References Cited

U.S. PATENT DOCUMENTS 1,900,906 A * 3/1933 Brown ..... 362/197
1,901,180 A * 3/1933 McBride ..... 362/105
4,862,331 A * 8/1989 Hanabusa ..... 362/106
D375,612 S * 11/1996 Elder ..... D2/894
D403,841 S * 1/1999 Drone ..... D2/894
6,146,006 A * 11/2000 Cross ..... 362/555
6,982,633 B2 * 1/2006 Burdick ..... 340/432
7,942,543 B2 * 5/2011 Ritter ..... 362/103
2009/0073679 A1 * 3/2009 Wainright ..... 362/191

* cited by examiner

*Primary Examiner* — Thomas Sember

(57) ABSTRACT

The "HeadLyte" Safety Device is intended to be attached or embedded within a helmet worn by a bicyclist, or, worn around the head of a walker or jogger. The "HeadLyte" is comprised of a band that is populated with light emitting devices providing 360 degrees of illumination. The purpose of this illumination is to alert other individuals and/or vehicles as to the presence and direction of travel of the person wearing the "HeadLyte", The light emitting devices are connected to a power source and a microcontroller that enables them to flash in a variety of patterns. The light emitting devices may also utilize color to indicate direction of color. The increased visibility provided by the light emitting devices, combined with the location of the "HeadLyte" as it is worn at the highest possible point on the walker, jogger or bicyclist will further enhance the visibility of the wearer to others.

4 Claims, 5 Drawing Sheets

Top View

*Note – the location and quantity of the LED's are for representation purposes only. Their exact location and quantity will vary.*

Figure 1. Top View
*Note – the location and quantity of the LED's are for representation purposes only. Their exact location and quantity will vary.*
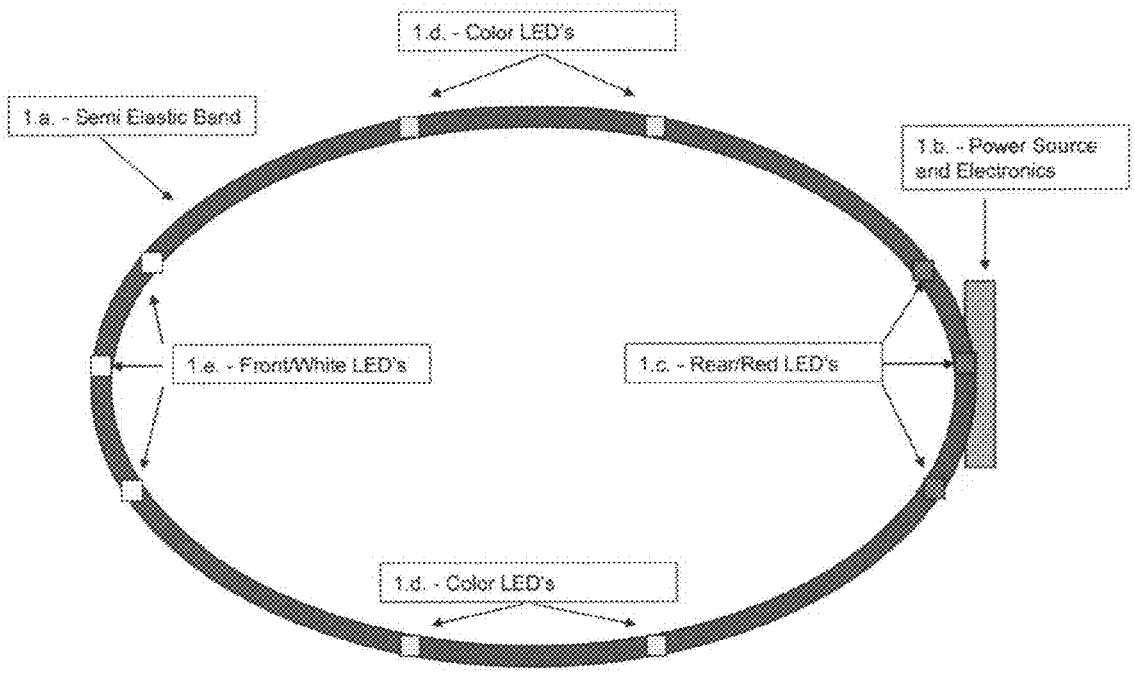

Figure 2. Rear View
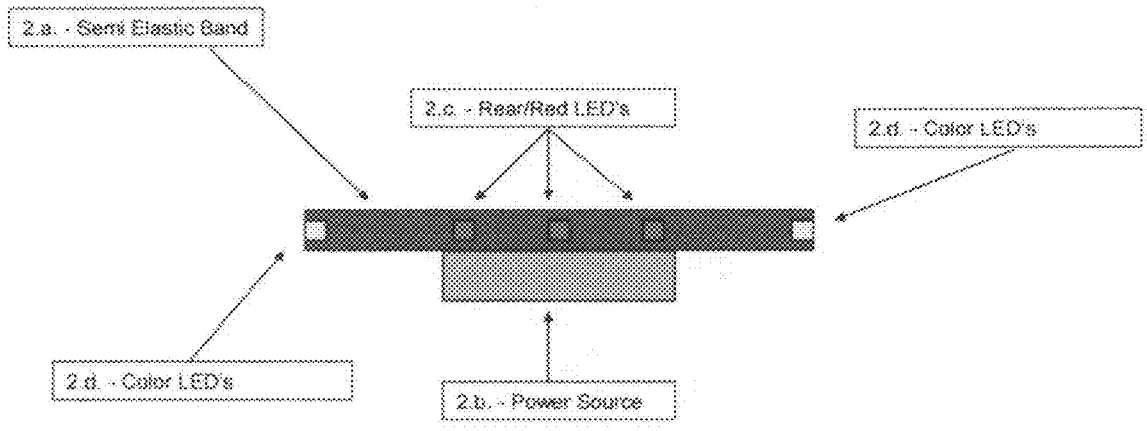

Figure 3. Front View
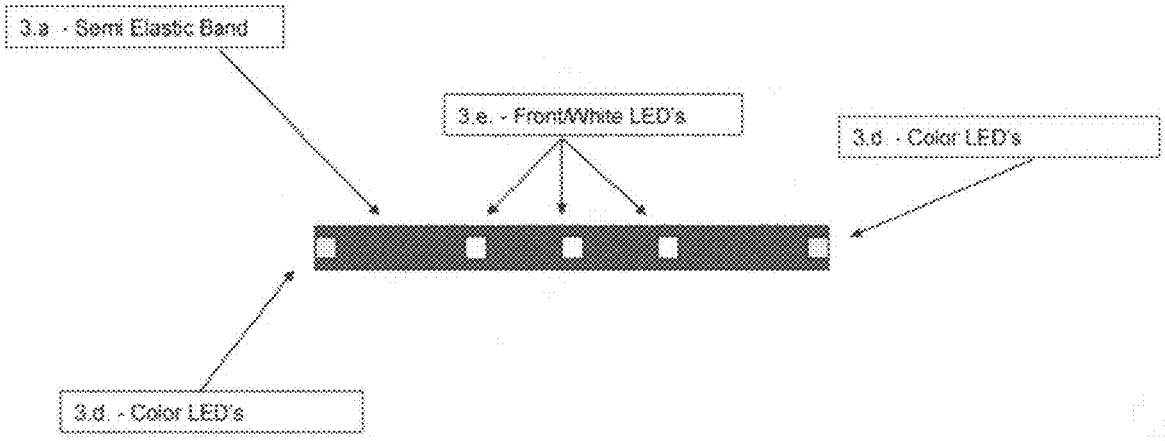

Figure 4. Band - Cross Section
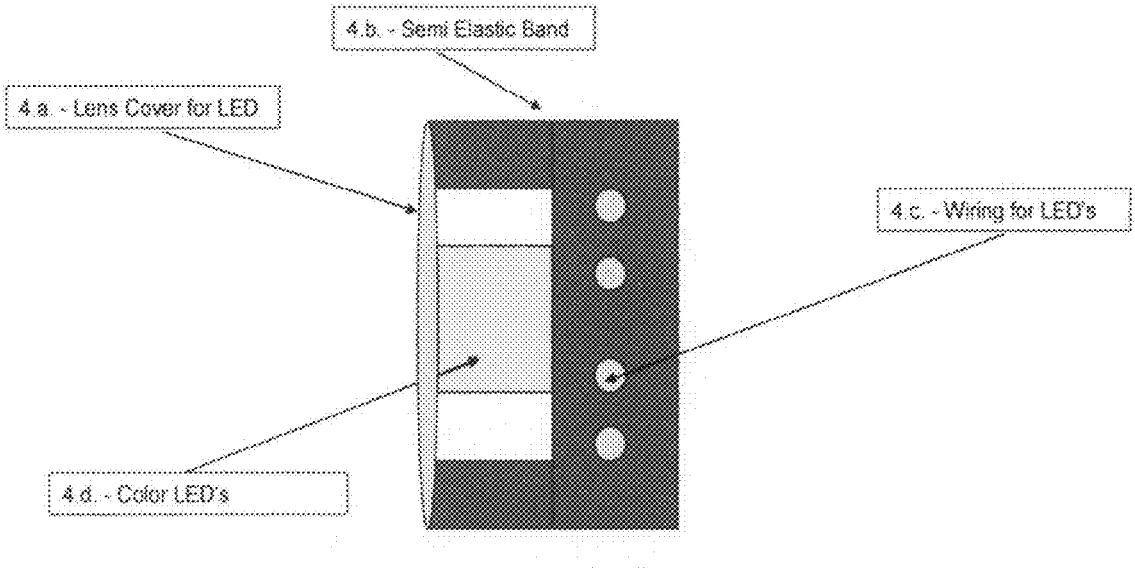

Figure 5. Electrical Diagram
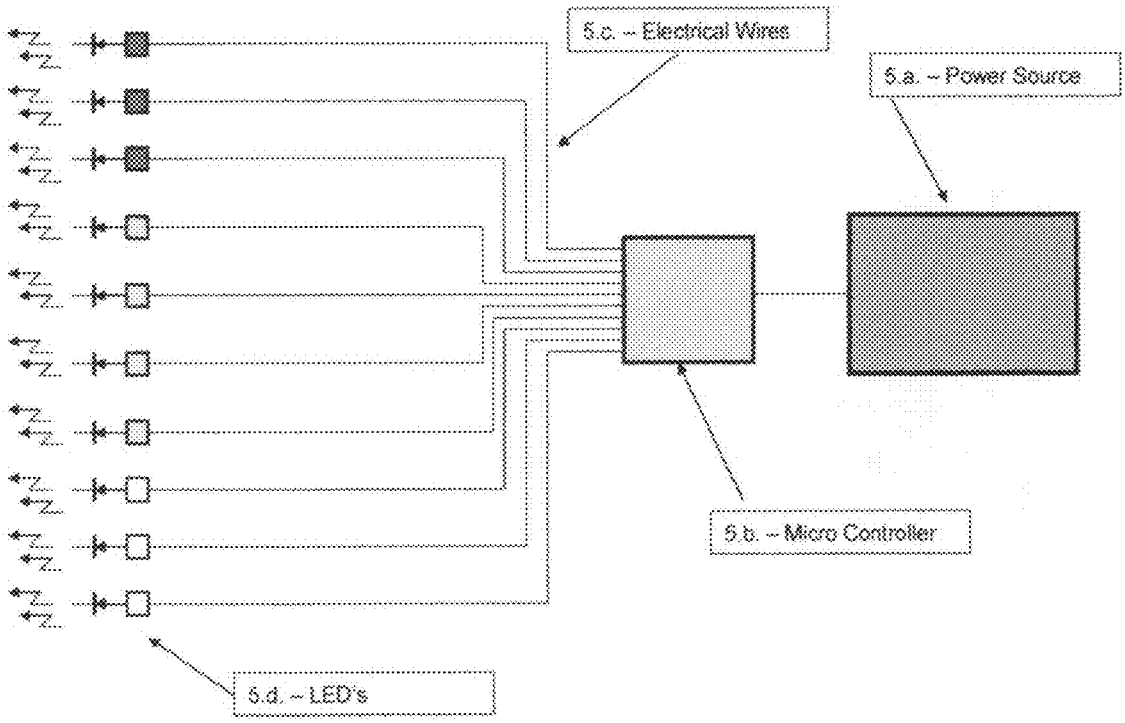

HEADLYTE SAFETY DEVICE

The invention is generally related to human powered transportation such as walkers and joggers, cyclists and individuals on roller blades or skateboards. Its purpose is to provide enhanced visibility for motorists and others who may come in contact with the user. The invention serves to alert other parties to the presence of the wearer of the invention. In addition, it may also inform them as to the wearer's direction of travel.

BACKGROUND OF THE INVENTION

Historically, individuals on bicycles, or joggers, may have attached a red light to the rear of their bicycle or attire to alert approaching traffic of their presence. This light may blink or provide a steady beam.

Each year, thousands of cyclists, walkers and joggers are struck by a motor vehicle causing serious injury or death. Up to half of these accidents occur when they are struck by a vehicle that is approaching them from either the front or the side. For example, a bicyclist proceeding down a road is struck by an oncoming vehicle which makes a left turn into the path of the bicyclist. In many of these cases, low visibility is to blame.

Most of the remaining accidents occur when the individual jogger or bicyclist is struck from behind, usually due to a lack of visibility. Often times, the individual was illuminated from the rear. However, the proximity of the mounted tail light positioned it too low on their person or bicycle and an approaching motorist was unable to see them until they had passed the point where they could still avoid contact.

BRIEF SUMMARY OF THE INVENTION

The invention will provide increased levels of safety to these pedestrians and cyclists by:

- providing increased visibility due to the height of the illumination the invention provides
- providing increased visibility due to sequential blinking
- informing approaching traffic of the wearers direction of travel through use of safety-standard colors
- providing increased visibility by providing 360 degrees of illumination This is accomplished by providing a 360 degree, illuminated device to be worn on the head or helmet of the individual. This illumination, by being both visible from any direction and being worn at the highest possible point on the individual will provide enhanced visibility and hence, safety.

DESCRIPTION OF THE DRAWINGS

FIG. 1:

As viewed from above. The blue oval (FIG. 1.*a*) represents a band of plastic, or rubber, or like material that may be wrapped or covered in a different material for the purposes of aesthetics, comfort or functionality.

It may be affixed to a helmet through tension as a result of the band's elasticity, or it may be affixed to the helmet with an adhesive backing. It may also be incorporated into the design of the helmet.

Attached to, or embedded within the band are a series of Light Emitting Diodes or other light emitting devices (LED's). These LED's may be configured in a variety of patterns, rows, etc. The LED's mounted in the rear (FIG. 1.*c*) may be of a red color while the ones mounted on or near the front (FIG. 1.*e*) may be of a white or other color.

The LED's mounted on the sides and/or diagonal (FIG. 1.*d*) may be of a variety of colors.

The LED's are connected to a microchip via wires running through or attached to the band. This microchip is then connected to a power source (FIG. 1.*b*) This power source consists of a battery or batteries.

FIG. 2:

This is the invention as viewed from the rear. Visible are the side mounted LED's within the band. These may be yellow, orange or green in color.

FIG. 3:

This is the invention as viewed form the front. Visible here are the front mounted LED's. Generally, these will be white in color.

FIG. 4:

This is the invention as viewed in cross section. The band (FIG. 4.*b*) will also act as a foundation for the wires FIG. 4.*c*) that connect the LED's to the power source.

The LED (FIG. 4.*d*) may have a lens or protective cover (FIG. 4.*a*) over it. This cover may provide enhancement to the illumination qualities of the LED, this cover may provide protection for the LED, or both.

FIG. 5:

This is a schematic of the electronics of the invention.

Essentially, the power source provides power to the LED's via the microchip. The microchip controls the sequence of the LEDs' illumination. This sequence may be "all on", "all blinking", "partially on", "partially blinking", sequential or any combination thereof.

DESCRIPTION OF THE INVENTION

A band constructed of firm or elastic material. This band is embedded with the appropriate wiring to connect a power source, a microchip or microcontroller and a multitude of light emitting diodes or other light emitting devices (LED's).

These lights are mounted on or within the band, and connected to the wiring constructed within the band. These wires are connected to a microchip or microcontroller that controls their illumination. Additional wiring connects the microchip/microcontroller to the power source.

These LED's are distributed around the circumference of the band. The band may:

- be worn on the head of a person walking or jogging
- be attached to an existing helmet through compression (hence the elasticity) or an adhesive
- be embedded within a helmet during design and manufacture The "HeadLyte" safety device is constructed by applying a multitude of light emitting devices (LED's) and associated wiring, power sources and controllers to an elastic band that can be attached to, worn on, or integrated into a safety helmet or individuals head.

These LED's will be arranged in a manner that allows them to be visible from any direction. They may flash or blink in a manner that increases their visibility to approaching motorists or other passers by.

Historically, bicyclists, joggers and the like have worn lights that are only visible from one direction, front or rear. In addition, these are most often worn in a low position, i.e. under the seat of a bicycle or on the belt of a jogger. The uniqueness of the HeadLyte lies in both its 360 degrees of visibility and its position on the individual, which is the highest point possible.

The controller may cause the lights to flash in a manner that is circular, sequential or all on, all off, etc. The controller may give the individual wearer the ability to select their method of illumination.

Additionally, by utilizing safety standard color conventions, one could potentially ascertain the direction of travel of the wearer by the color of the LED's as they approach.

The invention claimed is:

1. A circumferential illuminated band to be attached to a bicycle helmet worn by a user of a bicycle; comprising:

the circumferential illuminated band made of elastic material for flexibly attaching and detaching said illuminated band to said bicycle helmet;

said band having a front segment, opposing side segments and a rear segment;

a set of white light emitting diodes supported and incorporated within said front segment for providing white light in a forward direction of said bicycle;

a set of yellow, orange or green light emitting diodes supported and incorporated within said each opposing side segment for indicating a turning direction of said bicycle;

a set of red light emitting diodes supported and incorporated within said rear segment for providing red light in a rearward direction of said bicycle to warn observers behind the bicycle of the bicycle's position or location;

said LED sets supported on the front, opposing sides and rear segments are positioned around the entire circumference of said band so as to provide 360 degrees of illumination and visibility;

said band further comprising wiring and control circuitry mounted within the band for controlling the front, side and rear sets of lights with different modes of lighting, said lighting modes selected from "all on", "all blinking", "partially on", "partially blinking", sequential or any combination thereof; and a battery pack electrically connected to the band of LED's via an on/off switch.

2. The circumferential illuminated band to be attached to a bicycle helmet worn by a user of a bicycle as claimed in claim 1, wherein the illumination band is sealed to protect the LEDs and circuitry from weather driven elements.

3. The circumferential illuminated band to be attached to a bicycle helmet worn by a user of a bicycle as claimed in claim 1, wherein the light emitting diode sets are configured in multiple rows around the circumference of said illumination band to enhance visibility.

4. The circumferential illuminated band to be attached to a bicycle helmet worn by a user of a bicycle as claimed in claim 1, wherein the light emitting diode sets are covered by lenses for the purpose of protection, enhanced illumination or other alteration of the light emanating from the light emitting diodes.

* * * * *